US006918377B2

(12) United States Patent
Boltz

(10) Patent No.: US 6,918,377 B2
(45) Date of Patent: Jul. 19, 2005

(54) INWARD-OPENING VARIABLE FUEL INJECTION NOZZLE

(75) Inventor: Joachim Boltz, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/750,881

(22) Filed: Jan. 5, 2004

(65) Prior Publication Data

US 2004/0134465 A1 Jul. 15, 2004

(30) Foreign Application Priority Data

Jan. 3, 2003 (DE) ..... 103 00 045

(51) Int. Cl.[7] ..... F02M 45/00

(52) U.S. Cl. ..... 123/467; 123/299; 123/468; 239/88; 239/585.1; 239/533.11; 239/533.4; 251/360; 251/362

(58) Field of Search ..... 123/470, 299, 123/300, 467, 468; 239/88, 585.1, 533.11, 533.4; 251/360, 362

(56) References Cited

U.S. PATENT DOCUMENTS

| | | | | | |
|---|---|---|---|---|---|
| 1,834,061 | A | * | 12/1931 | Joachim | 239/410 |
| 4,202,500 | A | * | 5/1980 | Keiczek | 239/533.3 |
| 4,205,790 | A | * | 6/1980 | Keiczek | 239/533.4 |
| 5,458,292 | A | | 10/1995 | Hapeman | 239/533.4 |
| 5,771,865 | A | * | 6/1998 | Ishida | 123/467 |
| 6,725,841 | B1 | * | 4/2004 | Boecking | 123/467 |

FOREIGN PATENT DOCUMENTS

| | | |
|---|---|---|
| DE | 415 417 | 6/1925 |
| EP | 1 035 332 A2 | 9/2000 |
| WO | WO 02/18775 A1 | 3/2002 |

* cited by examiner

*Primary Examiner*—Tony M. Argenbright
*Assistant Examiner*—Johnny H. Hoang
(74) *Attorney, Agent, or Firm*—Ronald E. Greigg

(57) ABSTRACT

A fuel injection nozzle is proposed, in which an inner nozzle needle and an outer nozzle needle can be actuated independently of one another. Upon opening of the outer nozzle needle, a stream of fuel is injected into the combustion chamber in the direction of the longitudinal axis of the fuel injection nozzle, while upon opening of the inner nozzle needle, the fuel is injected laterally into the combustion chamber.

18 Claims, 6 Drawing Sheets

INWARD-OPENING VARIABLE FUEL INJECTION NOZZLE

BACKGROUND OF THE INVENTION

1. Field of the Invention

The invention relates to an improved fuel injection nozzle for an internal combustion engine and more particularly to such a nozzle having two coaxial nozzle needles.

2. Description of the Prior Art

From German Patent Disclosure DE 40 23 223 A1, a fuel injection nozzle with two nozzle needles disposed coaxially to one another is known. One common nozzle needle seat for both nozzle needles is provided in the valve body surrounding the nozzle needles. Consequently, both when the first nozzle needle is opened and when the second nozzle needle is opened, fuel is injected into the combustion chamber at an angle of 60°, for instance, to the longitudinal axis of the fuel injection nozzle. These injection angles are necessary, in the so-called heterogeneous operating mode of the engine.

In some load states of the engine, however, it is advantageous if the fuel is injected into the combustion chamber in the direction of the longitudinal axis of the fuel injection nozzle (homogeneous mode).

In International Patent Disclosure WO 02/18775, the distinction between the aforementioned homogeneous mode and the heterogeneous mode of an internal combustion engine is explained in detail. This explanation is hereby incorporated by reference.

OBJECT AND SUMMARY OF THE INVENTION

In a fuel injection nozzle for an internal combustion engine, having a nozzle body protruding into the combustion chamber, having two coaxial spring-loaded nozzle needles, the outer nozzle needle being guided in the nozzle body, having a first nozzle needle seat in the nozzle body for the outer nozzle needle and having a second nozzle needle seat for the inner nozzle needle, the inner nozzle needle is guided in the outer nozzle needle, and the first nozzle needle seat is disposed in the outer nozzle needle, it can be attained that injections can be accomplished both in the direction of the longitudinal axis of the fuel injection nozzle and at a virtually arbitrary angle to this longitudinal axis into the combustion chamber. As a result, the operating performance of the engine can be further optimized, which is advantageous especially in terms of noise and emissions from the engine.

In a variant of the fuel injection nozzle of the invention, it is provided that a first pressure chamber, cooperating with a pressure shoulder of the inner nozzle needle, is embodied in the outer nozzle needle, and that the first pressure chamber is acted upon, at least indirectly, with the pressure of a common rail via a supply bore in the outer nozzle needle.

It can furthermore be provided that the inner nozzle needle, with its end remote from the combustion chamber, defines a first control chamber, present in the outer nozzle needle, and that a closure element cooperating with the outer nozzle needle defines the first control chamber on the other end. In these embodiments, a structure of the fuel injection nozzle of the invention that is simpler in terms of production is made possible.

Alternatively, the diameter of the inner nozzle needle, on its end remote from the combustion chamber, can be greater than the diameter of the first pressure shoulder of the inner nozzle needle, or a closing spring which is braced on one end on the inner nozzle needle and on the other on the closure element can be present in the first control chamber. By means of these alternatives, which can also be combined with one another, the closure of the inner nozzle needle is assured hydraulically in one case and in the other by the prestressing of the closing spring.

Other variants of the fuel injection nozzle of the invention provide that the first control chamber is supplied with fuel from the common rail via a first inlet throttle, that the first control chamber communicates hydraulically with a fuel return via a first outlet throttle and via a first multi-way valve, in particular a 2/2-way valve, and the first inlet throttle can be disposed in the closure element or in the outer nozzle needle, and the first outlet throttle is disposed in the closure element. A common feature of all these variant embodiments is their ease of production, and because of the resultant high precision of production, a favorable operating performance of the fuel injection nozzle.

In a further feature of the invention, it is provided that the outer nozzle needle, with its end remote from the combustion chamber, defines a second control chamber, present in the nozzle body, on one end, and that the closure element defines the second control chamber on the other end. As a result, the number of components required is kept small, and simple production of the fuel injection nozzle of the invention is made possible.

In a further feature of this variant embodiment of the invention, it is provided that the second control chamber is supplied with fuel from the common rail via a second inlet throttle, and that the second control chamber communicates hydraulically with the fuel return via a second outlet throttle and via a second multi-way valve, in particular a 2/2-way valve.

Alternatively, the second control chamber can be supplied with fuel from the common rail via the supply bore, the first control chamber, and the second inlet throttle; in that case the second control chamber communicates hydraulically with the fuel return via a second outlet throttle and a second multi-way valve, in particular a 2/2-way valve, and the first pressure chamber can be acted upon by a pressure which is greater than the pressure in the common rail. This design of the fuel injection nozzle of the invention assures that the pressure required in the common rail need not be as high as the desired maximum injection pressure, and moreover the injection pressure is not applied permanently but instead only during the injection in the fuel injection nozzle.

To raise the pressure in the common rail to the desired injection pressure, between the common rail and the first pressure chamber a hydraulic pressure booster can be provided, whose low-pressure connection communicates hydraulically with the common rail and whose high-pressure connection communicates hydraulically with the first pressure chamber, and whose pressure in a diversion chamber can be made to communicate, via a 3/2-way valve, with either the common rail or the fuel return. By means of this pressure booster, the pressure can be raised in a simple, time-tested way, and the control of both the onset and duration of injection is accomplished by a suitable triggering of the 3/2-way valve.

To supply the high-pressure side of the pressure booster and thus also the fuel injection nozzle of the invention with fuel, between the common rail and the high-pressure chamber of the pressure booster, a hydraulic communication with a check valve can be provided.

A further advantageous feature of the invention provides that the second inlet throttle is disposed in the closure element, so that the adaptation of the inlet throttles and outlet throttles of the fuel injection nozzle of the invention can be done directly in the production of the closure element. Also by this means, the production of the fuel injection nozzle of the invention and its operating performance can be improved in a simple way. The deviations in operating performance of the fuel injection nozzles in large-scale mass production can also be lessened.

According to the invention, the multi-way valves can be actuated by an electromagnet or a piezoelectric actuator.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
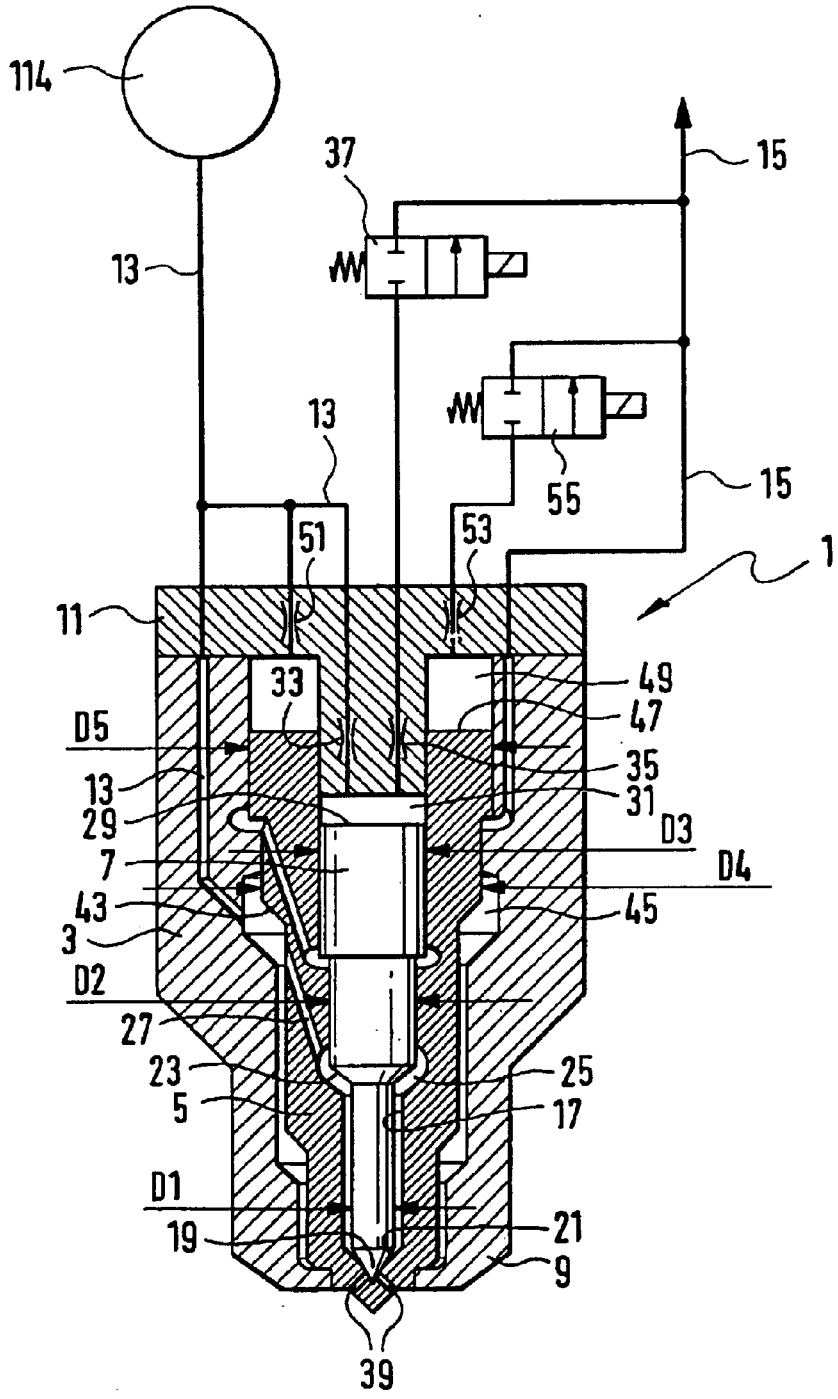
FIG. 1 shows a first exemplary embodiment of a fuel injection nozzle of the invention in longitudinal section.

In FIG. 1, a first exemplary embodiment of a fuel injection nozzle 1 of the invention is shown in longitudinal section. The fuel injection nozzle 1 essentially comprises a nozzle body 3, in which an outer nozzle needle 5 is guided sealingly. An inner nozzle needle 7 is guided, likewise sealingly, in the outer nozzle needle 5. With one end 9 toward a combustion chamber, not shown, of an internal combustion engine, the fuel injection nozzle 1 protrudes into that combustion chamber. On the end of the nozzle body 3 remote from the combustion chamber that is not shown, the nozzle body is closed with a closure element 11.

The fuel injection nozzle 1 is supplied with fuel that is at high pressure by a common rail 114 via a high-pressure fuel line 13. The control and leakage quantities are carried away via a fuel return 15.

As can be seen from FIG. 1, the outer nozzle needle 5 has a stepped center bore 17, in which the inner nozzle needle 7 is guided. The inner nozzle needle 7 essentially has three different diameters, which in FIG. 1 are marked D1, D2 and D3. Unless otherwise noted, the following relations apply: $D3 \geqq D2$, and $D1 \leqq D2$.

If $D3=D2$, a closing spring is required.

On its end toward the combustion chamber, the inner nozzle needle 7 has a first diameter D1, which merges with a pointed tip 19. In the closed state, the tip 19 of the inner nozzle needle 7 rests on a first nozzle needle seat 21, which is present on the end of the stepped center bore 17 of the outer nozzle needle 5.

Between the first diameter D1 and the second diameter D2, a pressure shoulder 23 is embodied on the inner nozzle needle 7. This first pressure shoulder 23 defines a first pressure chamber 25, formed by the stepped center bore 17 of the outer nozzle needle 5. The first pressure chamber 25 is supplied with fuel from the common rail 114 via a supply bore 27 in the outer nozzle needle 5 and the high-pressure line 13.

With its second diameter D2, the inner nozzle needle 7 is guided sealingly in the stepped center bore 17 of the outer nozzle needle 5.

On its end 29 remote from the combustion chamber, the inner nozzle needle 7 has a third diameter D3, which is greater than the second diameter D2, and defines a first control chamber 31. The inner nozzle needle 7 is also guided sealingly with its third diameter D3 in the stepped center bore 17 of the outer nozzle needle 5.

On the end opposite from the end 29 of the inner nozzle needle 7, the first control chamber 31 is defined by the closure element 11. The closure element 11 is placed, likewise sealingly, in the stepped center bore 17 of the outer nozzle needle 5. The inner nozzle needle 7 can move relative to the closure element 11 and to the outer nozzle needle 5.

The first control chamber 31 communicates hydraulically with the common rail 114 via the high-pressure line 13, in which there is a first inlet throttle 33. Via a first outlet throttle 35 and a first 2/2-way valve 37, the first control chamber can be made to communicate hydraulically with the fuel return 15.

The actuation of the inner nozzle needle 7 by triggering of the first 2/2-way valve 37 is accomplished as follows: If the inner nozzle needle 7 is to lift from the first nozzle needle seat 21 in order to trip an injection, the first 2/2-way valve 37 is opened, causing the pressure in the first control chamber 31 to drop, and as a result of the hydraulic force acting essentially on the first pressure shoulder 23, the inner nozzle needle 7 lifts from the first nozzle needle seat 21. As a consequence, fuel is injected into the combustion chamber through the first injection ports 39 disposed in the outer nozzle needle 5. As soon as the first 2/2-way valve 37 is closed again, the pressure in the first control chamber 31 rises again, and the hydraulic force acting on the end 29 of the inner nozzle needle 7 remote from the combustion chamber moves the inner nozzle needle 7 back against the first nozzle needle seat 21, counter to the hydraulic force acting on the pressure shoulder 23.

The outer nozzle needle 5 is guided sealingly with its diameters D4 and D5 in a stepped center bore 41 of the nozzle body 3. The stepped center bore 41, together with a second pressure shoulder 43 of the outer nozzle needle 5, defines a second pressure chamber 45.

With its end 47 remote from the combustion chamber, the outer nozzle needle 5 together with the closure element 11 and the stepped center bore 41 defines a second control chamber 49. Via a second inlet throttle 51, the second control chamber 49 communicates hydraulically with the common rail 114.

Via a second outlet throttle 53 and a second 2/2-way valve 55, the second control chamber 49 can be made to communicate with the fuel return 15. The second inlet throttle 51 and the second outlet throttle 53 are disposed in the closure element 11.

When the outer nozzle needle 5 is to lift from its seat in the nozzle body 3, the second 2/2-way valve 55 is opened, so that the pressure in the second control chamber 49 drops, and the hydraulic force acting on the second pressure shoulder 43 lifts the outer nozzle needle 5 from its seat, not shown, in the nozzle body 3. Once the nozzle needle 5 has lifted from its seat, not shown, in the nozzle body 3, fuel can be injected into the combustion chamber through second injection ports 40 shown in FIG. 4. In a first approximation, the fuel is injected in the direction of the longitudinal axis of the fuel injection nozzle 1.

As soon as the second 2/2-way valve 55 is closed again, a pressure increase occurs in the second control chamber 49, so that the outer nozzle needle 5 is pressed back onto its nozzle needle seat.

In dimensioning the fuel nozzle 1 of the invention, care must be taken to provide that the annular surface area on the end 47 of the outer nozzle needle 5 that is defined by the diameters D5 and D3 is greater than the area of the second pressure shoulder 43, so that for the same pressure in the second pressure chamber 45 and the second control chamber 49, a resultant hydraulic force occurs which presses the outer nozzle needle 5 against its sealing seat in the nozzle body 3.

The second injection ports 40, not shown in FIG. 1, of the outer nozzle needle 5 are disposed such that the fuel is injected (see also FIG. 4) in the direction of the longitudinal axis of the fuel injection nozzle 1 in the combustion chamber, not shown. Slight deviations between the direction of the injected fuel stream and the longitudinal axis of the fuel injection nozzle are also possible and may be wanted. As a result, in some operating states of the engine, improved combustion and emissions performance of the engine can be achieved.

If the fuel is to be injected laterally into the combustion chamber, not shown, the inner nozzle needle 7 is opened. It is also possible to open the inner nozzle needle 7 first and, with the inner nozzle needle 7 open, also to lift the outer nozzle needle 5 from its nozzle needle seat, so that a large fuel quantity is injected into the combustion chamber within a very brief time.

Figure 2:
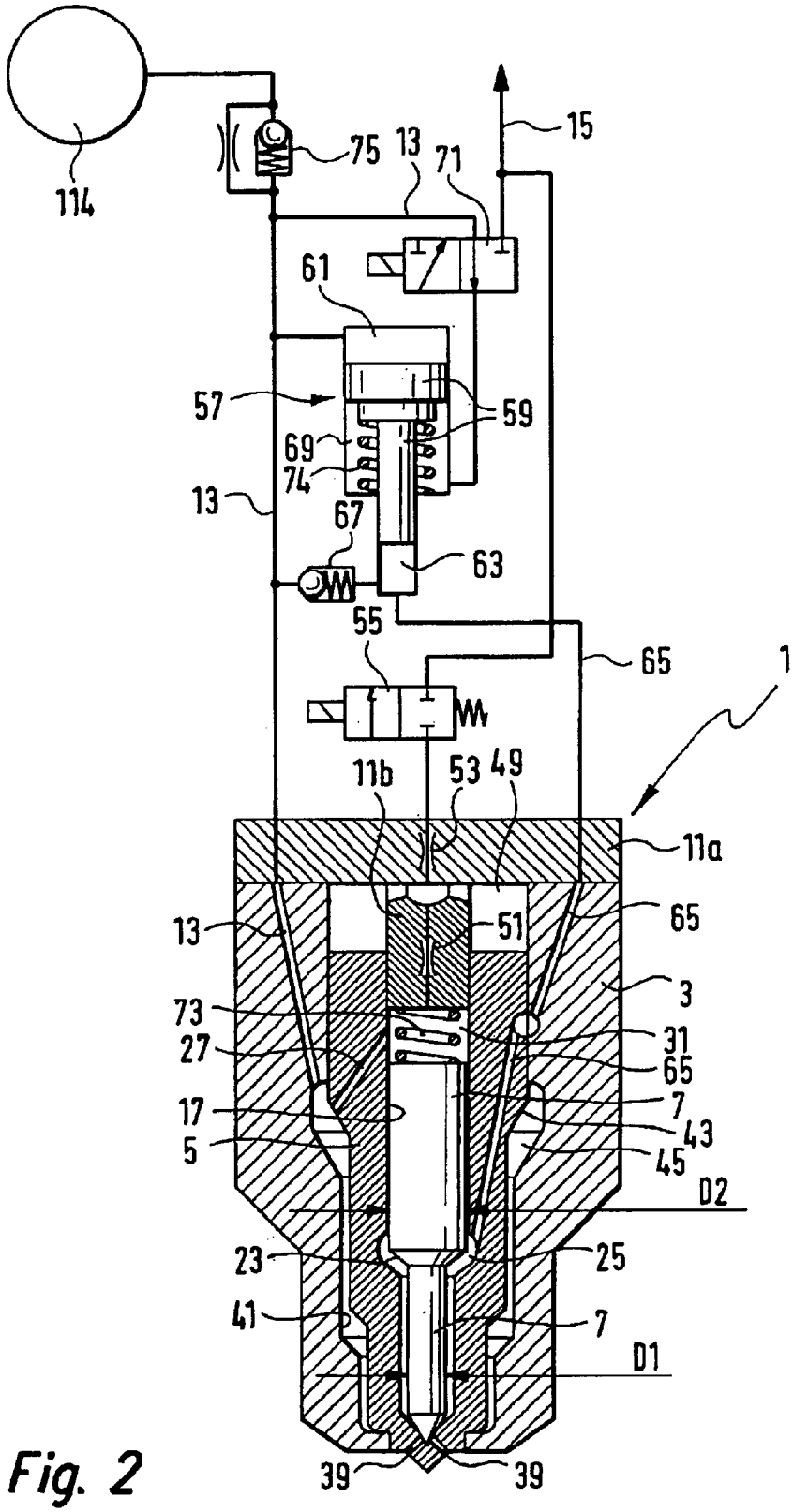
FIG. 2 shows a second exemplary embodiment of a fuel injection nozzle of the invention, with a pressure booster.

In FIG. 2, a second exemplary embodiment of a fuel injection nozzle 1 of the invention is shown, again in longitudinal section. Identical components are identified by the same reference numerals, and their description made in conjunction with FIG. 1 applies accordingly.

Between the high-pressure line 13 and the first pressure chamber 25, in this exemplary embodiment, a hydraulic pressure booster 57 is provided. The pressure booster 57 essentially comprises a stepped piston 59, which on one side defines a low-pressure chamber 61 and on the other a high-pressure chamber 63. The low-pressure chamber 61 communicates hydraulically with the common rail 114 via the high-pressure line 13. Via a line 65, which extends through the closure element 11, the nozzle body 3, and the outer nozzle needle 5, the high-pressure chamber 63 communicates with the first pressure chamber 25. The high-pressure chamber 63 is filled via a check valve 67, which is disposed between the high-pressure line 13 and the high-pressure chamber 63. A diversion chamber 69 of the pressure booster 57 communicates hydraulically with either the common rail 114 or the fuel return 15 via a 3/2-way valve 71. In the diversion chamber 69, a closing spring 74 is provided, which moves the stepped piston 59 upward in the switching position of the 3/2-way valve 71 shown in FIG. 2, which causes a reduction in size of the low-pressure chamber 61 and an increase in size of the high-pressure chamber 63. As soon as the 3/2-way valve 71 is switched over, causing the diversion chamber 69 to communicate hydraulically with the fuel return 15, the stepped piston 59 is moved downward in terms of FIG. 2, because the hydraulic forces operative in the low-pressure chamber 61 are greater than the hydraulic forces operative in the high-pressure chamber 63. As a consequence, the pressure in the first pressure chamber 25 rises, so that the hydraulic force acting on the first pressure shoulder 23 is greater than the hydraulic force exerted by the first control chamber 31 and than the force exerted on the inner nozzle needle 7 by a closing spring 73 located in the first control chamber 31. As a consequence of this, the inner nozzle needle 7 lifts from its first nozzle needle seat 21. When the inner nozzle needle 7 lifts from its sealing seat, the volume of the first control chamber 31 decreases. The fuel positively displaced as a result flows back into the high-pressure line 13 via the supply bore 27. Because of the simultaneous volumetric increase of the low-pressure chamber 61 of the pressure booster 57, the high-pressure line 13 is capable of absorbing the quantity of fuel positively displaced out of the first control chamber 31.

In the second exemplary embodiment, shown in FIG. 2, of a fuel injection nozzle 1 of the invention, the inner nozzle needle 7 opens under pressure control, so that a first inlet throttle and a first outlet throttle are not necessary.

In this exemplary embodiment, the inner nozzle needle 7 has only two diameters (D1 and D2). The closing force is brought to bear, as already noted, by the closing spring 73. This conception can also be employed in the exemplary embodiment of FIG. 1.

In this exemplary embodiment, the second control chamber 49 is supplied with fuel via a second inlet throttle 51, and the second inlet throttle 51 establishes a hydraulic communication between the first control chamber 31 and the second control chamber 49. In this exemplary embodiment, the closure element 11 is embodied in two parts. This is indicated in FIG. 2 by the reference numerals 11*a* and 11*b*. Because of the two-part embodiment of the closure element 11, any slight eccentricity of the stepped center bore 17 relative to the stepped center bore 41 can be compensated for. Moreover, this simplifies the production of the closure element 11.

The outer nozzle needle 5 is opened by opening the second 2/2-way valve 55, causing a pressure reduction in the second control chamber 49 via the second outlet throttle 53. As soon as the hydraulic force acting on the second pressure shoulder 43 is greater than the hydraulic force exerted on the outer nozzle needle 5 by the second control chamber 49, the outer nozzle needle 5 lifts from its nozzle needle seat in the nozzle body 3 and makes an injection possible.

In the high-pressure line 13, a combined check valve with a parallel-connected throttle, the latter two elements being identified overall by reference numeral 75, is provided in order to reduce pressure fluctuations in the common rail 114 and in the fuel injection nozzle 1.

Figure 3:
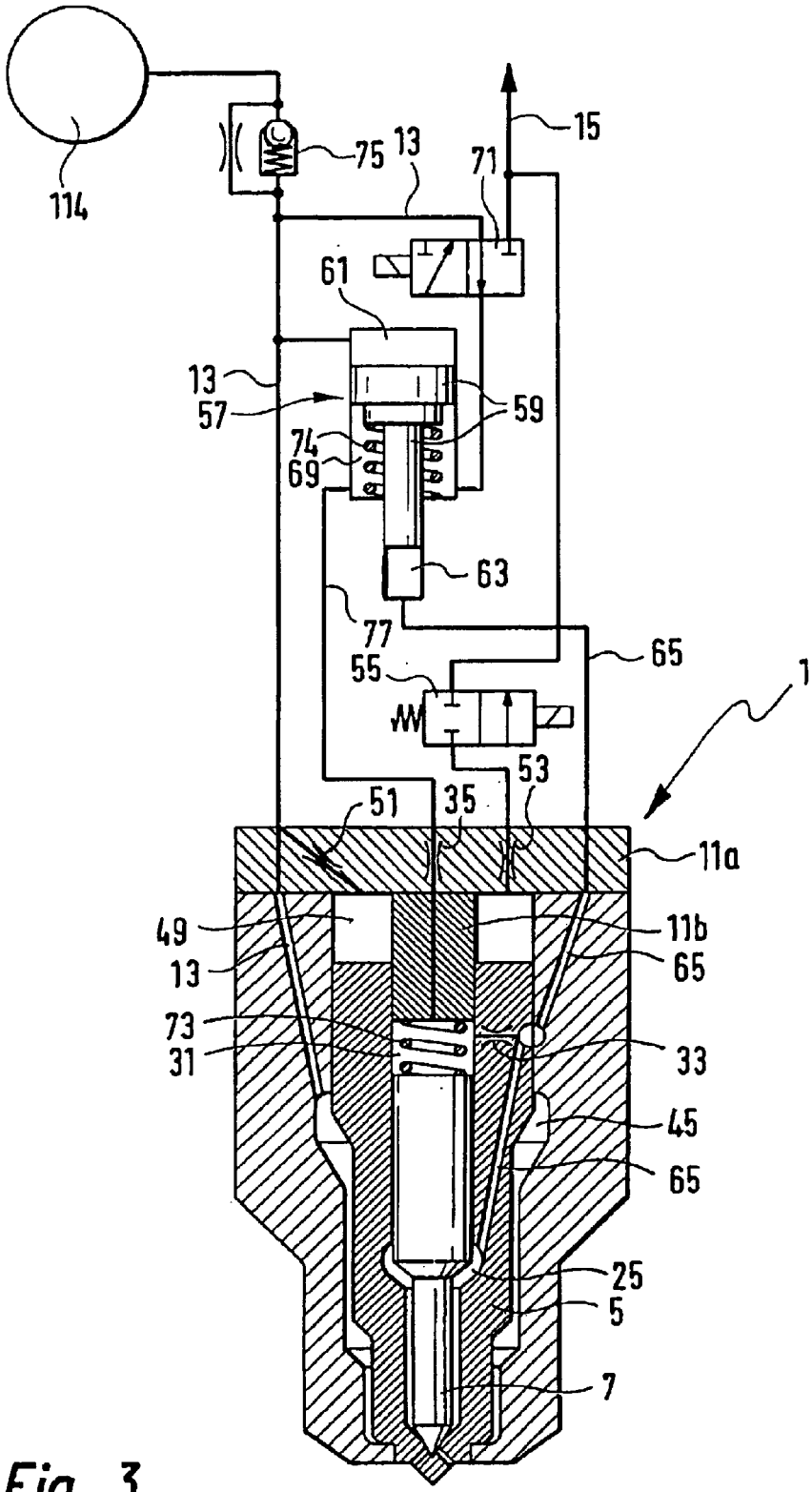
FIG. 3 shows a third exemplary embodiment of a fuel injection nozzle of the invention.

In FIG. 3, a further exemplary embodiment of a fuel injection nozzle 1 of the invention with a pressure booster 57 is shown. Below, only the essential differences will be described, while otherwise reference is made to the description above.

In a distinction from the exemplary embodiment of FIG. 2, the first control chamber 31 is supplied with fuel via a first inlet throttle 33 disposed in the outer nozzle needle 5. The first inlet throttle 33 communicates with the line 65 that connects the high-pressure chamber 63 of the pressure booster 57 with the first pressure chamber 25.

The first outlet throttle 35 communicates with the diversion chamber 69 of the pressure booster 57 via a line 77. This means that as soon as the 3/2-way valve 71 establishes a hydraulic communication of the fuel return 15 and the diversion chamber 69, the pressure in the first control chamber 31 also drops, and the inner nozzle needle 7 can thus open. In this exemplary embodiment, the second inlet throttle 51 is disposed in the closure element 11, between the high-pressure line 13 and the second control chamber 49. The second outlet throttle 53 is also disposed in the closure element 11*a*.

In FIG. 4, various embodiments of fuel injection nozzles of the invention are shown in simplified form and on a larger scale. With the enlargements shown in FIGS. 4*a*–4*d*, the intent above all is to explain and show various possible dispositions of second injection ports 40 in the fuel injection nozzle 1 of the invention. All the embodiments in FIGS. 4*a*–4*d* can be employed in any of the embodiments of FIGS. 1–3 that are explained at length above.

Figure 4B:
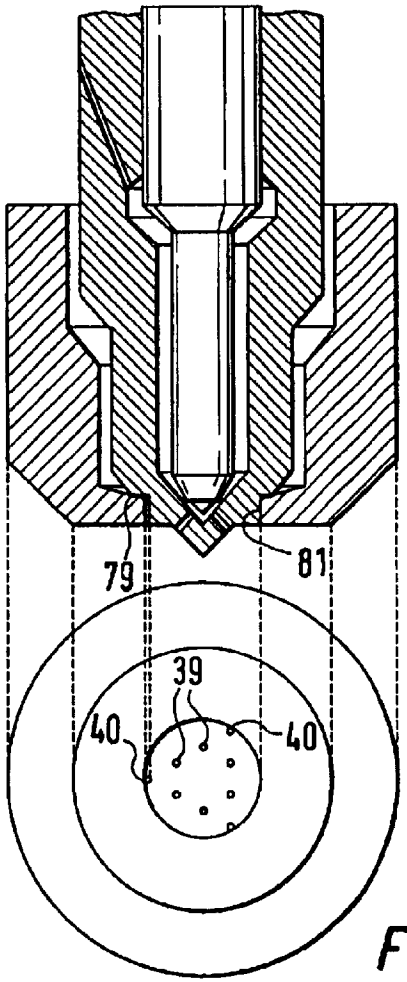
FIGS. 4*a*, 4*b*, 4*c* and 4*d* show enlarged views of the injection ports of exemplary embodiments of fuel injection nozzles of the invention.
Figure 4A:
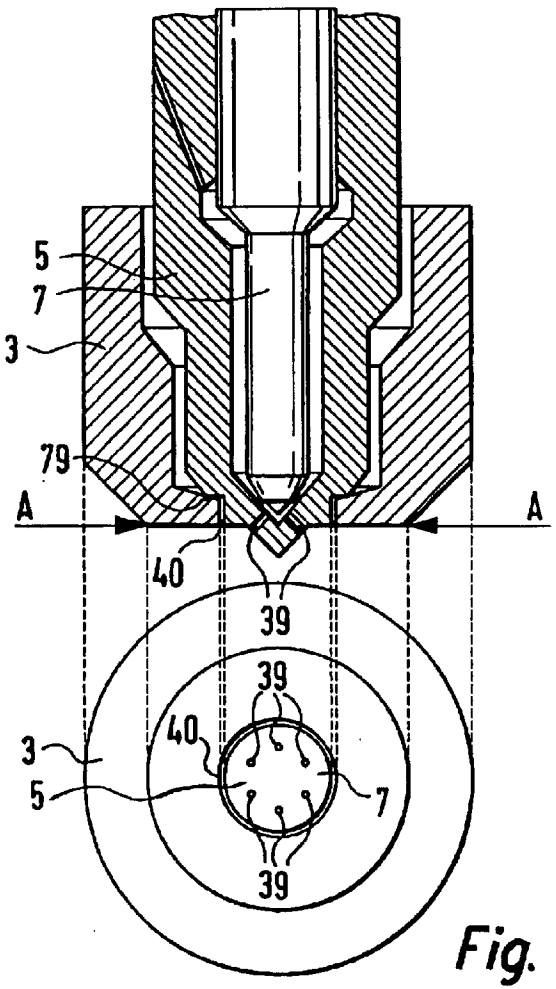

In the exemplary embodiment of FIG. 4*a*, a second nozzle needle seat 79 can be seen. The second nozzle needle seat 79 indicates the line of contact between the outer nozzle needle 5 and the nozzle body 3, in the closed state of the fuel injection nozzle 1. The second injection port 40, in this exemplary embodiment, is formed by a cylindrical annular gap between the nozzle body 3 and the outer nozzle needle 5. The second injection port 40 is not uncovered until the outer nozzle needle 5 lifts from the nozzle body 3 and thus uncovers the second nozzle needle seat 79.

In the exemplary embodiment of FIG. 4*b*, grooves are distributed over the circumference in the outer nozzle needle 5 and, together with the nozzle body 3, these grooves form the second injection ports 40.

Figure 4D:
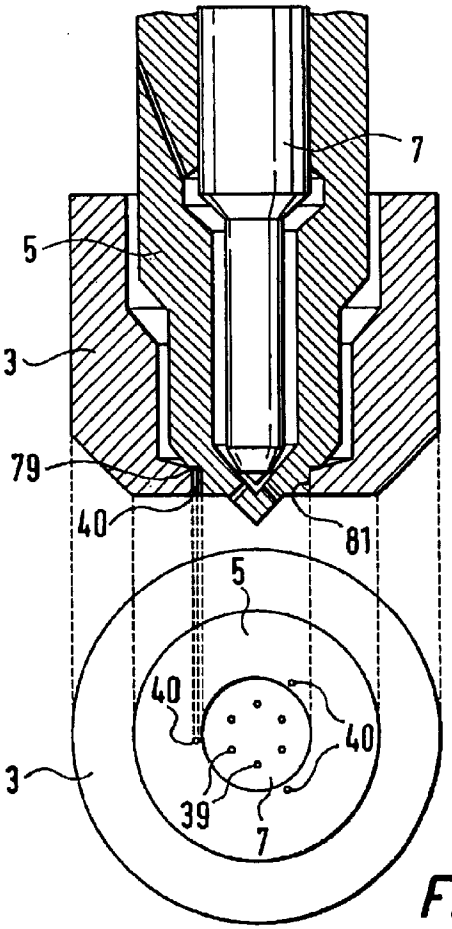
Figure 4C:
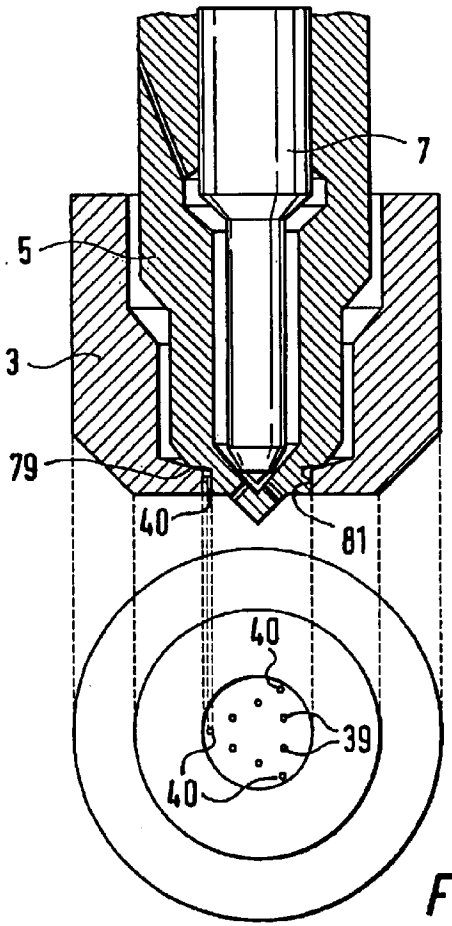

In the exemplary embodiment of FIG. 4*c*, the second injection ports 40, like the first injection ports 39, are disposed in the outer nozzle needle 5.

In the exemplary embodiment of FIG. 4*d*, the second injection ports 40 are disposed in the nozzle body 3 between the second nozzle needle seat 79 and the guide 81 of the outer nozzle needle 5.

Figure 5:
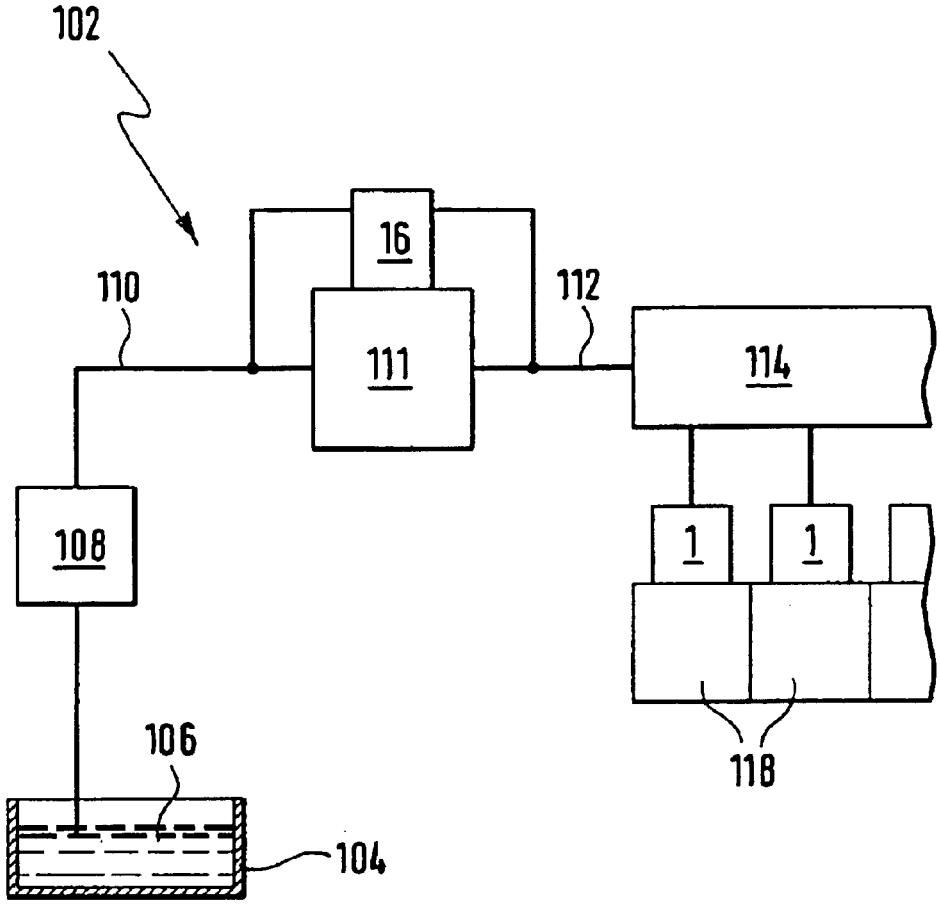
FIG. 5 schematically shows a fuel injection system with fuel injection nozzles of the invention.

Referring now to FIG. 5, it will now be explained how the fuel injection nozzle 1 of the invention is integrated with a fuel injection system 102 of an internal combustion engine. The fuel injection system 102 includes a fuel tank 104, from which fuel 106 is pumped by means of an electrical or mechanical fuel pump 108. Via a low-pressure fuel line 110, the fuel 106 is pumped to a high-pressure fuel pump 111. From the high-pressure fuel pump 111, the fuel 106 reaches a common rail 114 via a high-pressure fuel line 112. A plurality of fuel injection nozzles 1 according to the invention are connected to the common rail and inject the fuel 106 directly into combustion chambers 118 of an internal combustion engine, not shown.

The foregoing relates to preferred exemplary embodiments of the invention, it being understood that other variants and embodiments thereof are possible within the spirit and scope of the invention, the latter being defined by the appended claims.

I claim:

1. A fuel injection nozzle for an internal combustion engine, the injection nozzle comprising a nozzle body (3) protruding into the combustion chamber, two coaxial nozzle needles (5, 7), the outer nozzle needle (5) being guided in the nozzle body (3), a second nozzle needle seat in the nozzle body (3) for the outer nozzle needle (5), and a first nozzle needle seat for the inner nozzle needle (7), the inner nozzle needle (7) being guided in the outer nozzle needle (5), and the first nozzle needle seat (21) being disposed in the outer nozzle needle (5), wherein the inner nozzle needle (7), with its end (29) remote from the combustion chamber, defines one end of a first control chamber (31), present in the outer nozzle needle (5), and a closure element (11, 11*a*, 11*b*) cooperating with the outer nozzle needle (5) defines the other end of the first control chamber (31).

2. The fuel injection nozzle in accordance with claim 1, further comprising a first pressure chamber (25) in the outer nozzle needle (25), the chamber (25) cooperating with a first pressure shoulder (23) of the inner nozzle needle (7), the first pressure chamber (25) being acted upon, at least indirectly, with the pressure of a common rail (114) via a supply bore (27) in the outer nozzle needle (5).

3. The fuel injection nozzle in accordance with claim 1, wherein the diameter (D3) of the inner nozzle needle (7), on its end (29) remote from the combustion chamber, is greater than the diameter (D2) of the first pressure shoulder (23) of the inner nozzle needle (7).

4. The fuel injection nozzle in accordance with claim 1, wherein the diameter (D3) of the inner nozzle needle (7), on its end (29) remote from the combustion chamber, is equal to the diameter (D2) of the first pressure shoulder (23) of the inner nozzle needle (7).

5. The fuel injection nozzle in accordance with claim 1, further comprising a closing spring (73) in the first control chamber (31), the closure spring (73) being braced on one end on the inner nozzle needle (7) and on the other on the closure element (11).

6. The fuel injection nozzle in accordance with claim 3, further comprising a closing spring (73) in the first control chamber (31), the closure spring (73) being braced on one end on the inner nozzle needle (7) and on the other on the closure element (11).

7. The fuel injection nozzle in accordance with claim 4, further comprising a closing spring (73) in the first control chamber (31), the closure spring (73) being braced on one end on the inner nozzle needle (7) and on the other on the closure element (11).

8. The fuel injection nozzle in accordance with claim 1, wherein the first control chamber (31) is supplied with fuel from the common rail (114) via a first inlet throttle (33); and wherein the first control chamber (31) communicates hydraulically with a fuel return (15) via a first outlet throttle (35) and via a first multi-way valve, in particular a 2/2-way valve (37).

9. The fuel injection nozzle in accordance with claim 8, wherein the first inlet throttle (33) is disposed in the closure element (11) or in the outer nozzle needle (5).

10. The fuel injection nozzle in accordance with claim 5, wherein the first outlet throttle (35) is disposed in the closure element (11).

11. The fuel injection nozzle in accordance with claim 9, wherein the first outlet throttle (35) is disposed in the closure element (11).

12. The fuel injection nozzle in accordance with claim 1, wherein the outer nozzle needle (5), with its end (47) remote from the combustion chamber, defines one end of a second control chamber (49), present in the nozzle body (3), and wherein the closure element (11) defines the other end of the second control chamber (49).

13. The fuel injection nozzle in accordance with claim 12, wherein the second control chamber (49) is supplied with fuel from the common rail (114) via a second inlet throttle (51); and wherein the second control chamber (49) communicates hydraulically with the fuel return (15) via a second outlet throttle and via a second multi-way valve, in particular a 2/2-way valve (55).

14. The fuel injection nozzle in accordance with claim 8, wherein the second control chamber (49) is supplied with fuel from the common rail (114) via the closure element (11) and the second inlet throttle (51); wherein the second control chamber (49) communicates hydraulically with the fuel return (15) via the second outlet throttle (53) and via the second multi-way valve, in particular a 2/2-way valve (55); and wherein the first pressure chamber (25) can be acted upon by a pressure which is greater than the pressure in the common rail (114).

15. The fuel injection nozzle in accordance with claim 14, further comprising a hydraulic pressure booster (57)

between the common rail (114) and the first pressure chamber (25); the pressure booster (57) including a low-pressure chamber (61) (57) communicating hydraulically with the common rail (114) and a high-pressure chamber (63) communicating hydraulically with the first pressure chamber (25), and a diversion chamber (69) of the which can be made to communicate with either the common rail (114) or the fuel return (15) via a 3/2-way valve (71).

16. The fuel injection nozzle in accordance with claim 15, further comprising a hydraulic communication with a check valve (67) between the common rail (114) and the high-pressure chamber (63) of the pressure booster (57).

17. The fuel injection nozzle in accordance with claim 14, wherein the second inlet throttle (51) is disposed in the closure element (11).

18. The fuel injection nozzle in accordance with claim 14, wherein the multi-way valves (37, 55, 71) are actuated by an electromagnet or a piezoelectric actuator.

* * * * *